United States Patent [19]

Strok

[11] Patent Number: 4,868,457

[45] Date of Patent: Sep. 19, 1989

[54] CERAMIC LAMP END CLOSURE AND INLEAD STRUCTURE

[75] Inventor: Jack M. Strok, Garrettsville, Ohio

[73] Assignee: General Electric Company, Schenectady, N.Y.

[21] Appl. No.: 691,307

[22] Filed: Jan. 14, 1985

[51] Int. Cl.[4] ..... H01J 17/18

[52] U.S. Cl. ..... 313/625; 313/318; 313/565; 313/639

[58] Field of Search ..... 313/625, 642, 639, 242, 313/318, 565, 47, 45

[56] References Cited

U.S. PATENT DOCUMENTS

| | | | |
|---|---|---|---|
| 3,753,019 | 8/1973 | Hellman | 313/47 |
| 3,892,993 | 7/1975 | Timmermans | 313/318 |
| 4,065,691 | 12/1977 | McVey | 313/625 |
| 4,342,938 | 8/1982 | Strok | 313/174 |
| 4,459,509 | 7/1984 | Csapody et al. | 313/565 |

*Primary Examiner*—David K. Moore

*Attorney, Agent, or Firm*—Edward M. Corcoran; Stanley C. Corwin; Fred Jacob

[57] ABSTRACT

The life and performance of high pressure sodium vapor lamps using double wire ceramic seals and no exhaust tube is improved by an end closure and inlead structure which prevents condensation of sodium-mercury amalgam on sealing frit. One end of the arc tube has a plug portion which forms an integral part of the alumina tube without any sealing frit or glass intervening between portions. The plug portion includes a pedestal portion which projects inwardly from the outer region which is joined to the tube. The pedestal defines with the tube wall a ring chamber in which excess amalgam collects out of contact with any sealing frit. The other end of the tube is conventionally sealed by using sealing frit to cement an alumina plug but it is designed to run hotter to prevent condensation of amalgam at that end.

9 Claims, 1 Drawing Sheet

CERAMIC LAMP END CLOSURE AND INLEAD STRUCTURE

The invention relates to an improved end closure and inlead structure for the ceramic arc tube of a high pressure alkali metal lamp.

BACKGROUND OF THE INVENTION

A high pressure alkali metal vapor lamp generally comprises an inner arc tube of ceramic material resistant to the attack of the alkali metal vapor at high temperatures, ordinarily polycrystalline alumina and occasionally monocrystalline alumina (synthetic sapphire), within an outer protective envelope of glass. The arc tube contains the discharge filling or ionizable medium comprising an alkali metal such as sodium, generally as an amalgam with mercury and in a quantity considerably in excess of that vaporized during operation, and an inert gas such as xenon to facilitate starting. The ends of the ceramic tube are sealed by suitable closures affording connection to the thermionic electrodes inside. The outer vitreous envelope is usually provided with a screw base having shell and center contacts to which the electrodes are connected. The inter-envelope space is usually evacuated in order to conserve the heat of the arc tube.

The end closures which have been most widely utilized comprise a metal cap, preferably of niobium whose coefficient of thermal expansion is a fair match for that of alumina, hermetically sealed to the end of the alumina tube by a sealing frit or glass. The electrodes are directly attached to these caps to which external electrical connections are made and which thus also perform the function of inleads. One of the caps has a metal exhaust tube extending through it which is used to exhaust air from the tube and introduce the discharge filling during manufacture. It is then sealed off and serves as an external reservoir for the excess sodium-mercury amalgam which condenses in it because during operation it presents the coldest spot to which the filling of the lamp has access.

Ceramic closures are also widely used and of late they have gained favor for reasons of economy, particularly for small wattage lamps such as lamps of less than 100 watts rating. One design of end seal described in U.S. Pat. No. 3,882,346—McVey, utilizes an alumina ceramic plug sealed in the end of the arc tub and having a central perforation through which extends a lead wire of ceramic-matching metal. The sealing is effected through a glassy sealing composition comprising primarily aluminum oxide and calcium oxide, which melts when the assembly is suitably heated and forms the ceramic-to-ceramic and ceramic-to-metal sealing cement upon cooling. Lamps using such a ceramic closure at one end and a ceramic plug through which extends a niobium exhaust tube at the other end are described in U.S. Pat. No. 4,342,938—Strok. They have been commercially successful and are manufactured in large quantities. Such lamps, sometimes known as single wire seal lamps, are cheaper to make than lamps using metal caps and are substantially equally long-lived.

High pressure sodium lamps using identical ceramic closures at both ends and no exhaust tube are also well known. In their manufacture one of the discharge tube ends is provided with a ceramic closure in the form of an alumina plug through which is sealed an inlead supporting an electrode. The tube (or a batch of such tubes) is then placed in a suitable chamber with the sealed end lowermost, the amalgam put in, and the upper ceramic closure with inlead and electrode is located at the upper end together with sealing frit appropriately distributed to flow into and seal the crevices at the joints when melted. The chamber is first flushed, evacuated, and then filled with the inert gas atmosphere (xenon) desired in the finished lamp. Then while maintaining the lower end cool, the upper end of the tube is heated until the sealing frit flows into the crevices or gaps between alumina plug and tube wall and between plug and inlead. Upon cooling, the arc tube is hermetically sealed and the inert gas pressure in it is of course determined by the pressure in the chamber when the sealing frit solidified. Lamps of this kind using ceramic closures in which a wire inlead is sealed through at each end are sometimes known as double wire seal lamps.

High pressure sodium lamps of the double wire seal kind have been observed to have lives which are much shorter than those of single wire seal lamps, as little as half as long or even less. In such lamps the unvaporized excess of sodium-mercury amalgam, which always finds the coldest spot in the arc tube whereat to condense, generally condenses in the end corners, that is in the right angle where the alumina end plug meets the alumina tube wall. During lamp operation, the amalgam condensed in the end corners lies in contact with and generally covers the internal fillet of sealing frit or glass. It appears that the sealing frit is much less resistant to attack by sodium-mercury liquid condensate than by sodium-mercury vapor at the same temperature. The sealing frit is highly hygroscopic and sensitive to atmospheric impurities. It is theorized that the resistance of the sealing frit to sodium is reduced substantially by the slightest degree of contamination and the reduction is greater when the contact is by liquid sodium than by sodium vapor. The chemical attack on the sealing frit by sodium reduces the ratio of sodium to mercury atoms in the vapor discharge. The result is progressive lamp voltage rise and color shift towards red. Ultimately lamp cycling occurs when the ballast open-circuit voltage can no longer sustain the discharge. Chemical attack can also eventually destroy the hermetic seal and the life of the lamp is prematurely ended.

SUMMARY OF THE INVENTION

The object of the invention is to improve the life and performance of a double wire seal lamp by means of an end closure and inlead structure which prevents condensation of amalgam on sealing frit.

In accordance with the invention, one end of the discharge envelope or arc tube has a plug or stopper portion forming an integral part of the ceramic structure of the tube. In other words, tube and plug form a unitary structure without any sealing frit or glass intervening between portions. The plug is apertured and includes a pedestal portion projecting inwardly from the outer region which is joined to the tube. The inlead which supports an electrode extends through and is sealed in the aperture and emerges into the arc tube at the inner end of the pedestal. Together with the tube wall, the pedestal defines an annular compartment or ring chamber at its base in which excess amalgam collects. Due to its distance from the arc and it physical separation from the wire inlead going through the pedestal, the temperature of the ring chamber remains at all times appreciably lower than that of the inner end of the pedestal. As a result excess amalgam collects in the chamber and there is no tendency for amalgam to condense at the inner end of the pedestal where it would come into contact with sealing frit.

In a preferred embodiment, the ring chamber is dimensioned to hold the entire charge of amalgam by capillary attraction notwithstanding shock and vibration, and irrespective of lamp orientation or attitude. The other end of the arc tube is sealed in conventional fashion by using sealing frit or glass to bond or cement to the arc tube wall a conventional ceramic closure comprising an inlead supporting an electrode sealed through an alumina plug. Amalgam is prevented from condensing on the internal fillet of sealing frit at this cemented end by raising its temperature in any convenient way, as by radiation shields or by using a relatively shorter electrode shank.

DETAILED DESCRIPTION

The illustrated ceramic arc tube 1 comprises a main tubular portion 2 with lower and upper end closures 3 and 4. The main tube portion 2 and the plug portion 5 of the lower closure form a single unitary structure of polycrystalline alumina ceramic. Tube portion 2 and plug portion 5 may be prepared in known fashion by molding pure alumina powder with minute additions of other metal oxides such as magnesia, and preliminarily firing at a low temperature to bind the particles together. It is generally more convenient to make the tube by extruding under pressure a wet paste of the alumina into long lengths, preliminarily firing, and then cutting the resulting "green" compact into the desired lengths for individual arc tubes. Apertured plug portions are separately molded and fired in the same way to the "green" state. A plug is then fitted into one end of each arc tube length and the plugged tubes are then fired at very high temperatures in the range of 1800° to 1950° in vacuum or in a hydrogen atmosphere in known manner first taught in U.S. Pat. No. 3,026,210—Coble, until the "green" chalky and opaque compact is converted into translucent polycrystalline alumina ceramic.

Figure 2:
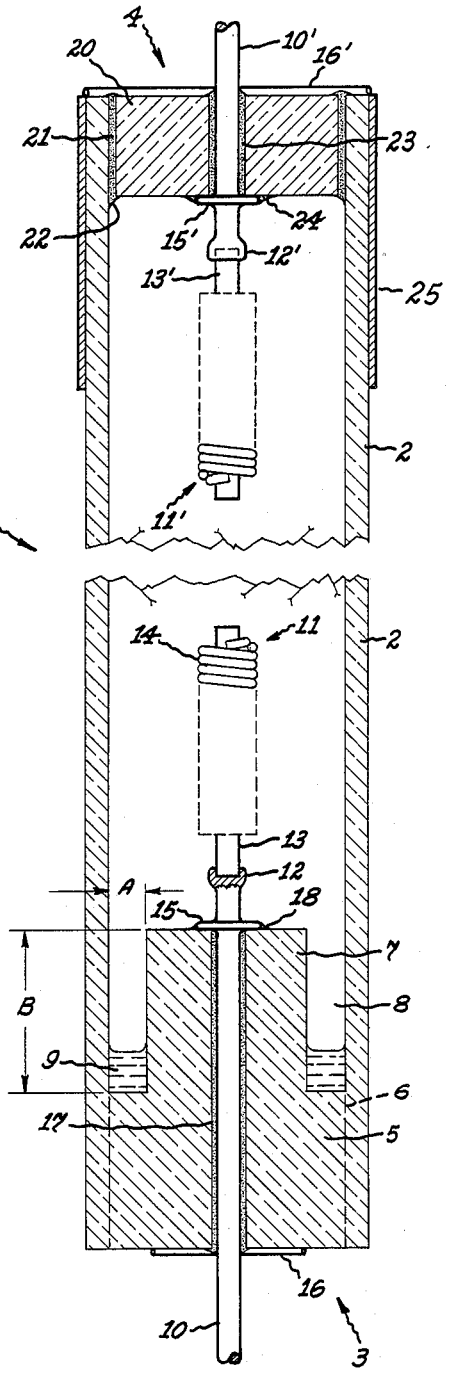
FIG. 2 is a sectional view with the central portion of the tube cut out in order to shorten the figure and allow the ends to be drawn to a larger scale.

In the firing process the linear dimensions of the article are reduced by 20% or more and the boundary or interface between tube and plug, indicated by the demarcation lines 6 in FIG. 2, disappears. Thus tube portion 2 and plug portion 5 have become a single unitary structure of polycrystalline alumina ceramic without any joint of extraneous material such -as sealing frit between them. The plug portion includes a generally cylindrical pedestal portion 7 rising up from the region of commonality with the wall and defining with the wall an annular chamber or compartment 8 for holding unvaporized excess sodium-mercury amalgam shown at 9.

The ceramic tube 2 with integral apertured plug 5 is made into an arc tube by first sealing into the aperture an inlead-electrode assembly comprising niobium wire 10 to which an electrode 11 is attached by a weld knot 12. The electrode conventionally comprises a tungsten shank 13 having one or more layers of tungsten wire 14 coiled around it and retaining an electron emissive material such as barium calcium tungstate ($Ba_2CaWO_3$) between turns. The niobium wire is upset at 15 to provide a shoulder which serves to locate the electrode with respect to the top of the pedestal.

The lower electrode-inlead assembly is sealed in while the tube is held with the plugged end up, that is, upside down relative to the illustration of FIG. 2. A cross-wire 16 is spot-welded to the niobium inlead wire to retain it in place and prevent it from falling out during sealing. The sealing frit or glass may be provided as a powder surrounding inlead wire 10 where it comes out of the plugged end of the tube or preferably in the form of a washer of pressed powder which is threaded over the projecting portion of the wire. One sealing composition which may be used consists of approximately 54% $Al_2O_3$, 38.5% CaO and 7.5% MgO by weight, but other compositions may be used. Upon heating, the frit melts and is drawn by capillarity into the aperture, filling it as illustrated at 17 and forming a minor pool at 18 on the pedestal about the upset.

The tube is then placed in a suitable chamber with the sealed end down and the sodium-mercury amalgam charge is put in. The chamber may be in the form of a dry box which is flushed with inert gas and manipulation of parts may be done by reaching in through glove shields. The upper ceramic closure comprises niobium inlead wire 10' to which electrode 11' is attached by weld knot 12' and a centrally apertured alumina ceramic disc 20. The wire is threaded through the aperture in the disc up to the upset 15'0 and a cross-wire 16' is spot-welded to the wire to lock the inlead-electrode assembly to the disc. The disc or plug is dimensioned to fit easily into the open end of tube 2 and cross wire 16' over-reaches the tube walls to hold the assembly in place during sealing. The sealing frit may again be provided in the form of a pressed washer threaded over the upwardly projecting portion of the wire.

For the final sealing and cementing operation, the arc tube and closure assembly may be transferred from the dry box directly into a vacuum furnace. Prior to actual sealing the furnace is filled with the gas such as xenon or the inert gas mixture desired in the finished lamp. Either cooling means or a large heat sink may be provided to keep the lower end of the tube cool enough to avoid vaporization of the amalgam charge while the upper end is heated to the melting temperature of the sealing frit. The liquified frit is drawn by capillary action into the ring-like crevice at 21 between arc tube and plug and forms a fillet at 22. It is also drawn into the aperture at 23 about the inlead wire 10' and forms a minor pool at 24 about the upset 15'. The seal is made when the frit solidifies upon cooling. By varying the pressure of the inert gas in the vacuum furnace any desired pressure may be provided in the finished arc tube or lamp.

During operation the source of heat is the arc extending between electrodes 11 and 11' and the temperature is highest on the axis in the space between them. The heat is dissipated primarily by radiation but the inleads also lose beat by conduction to the frame which conventionally supports the arc tube within an outer jacket. Ring chamber 8 at the integrally plugged end of the arc tube, due to its location radially outward from the axis to the maximum extent possible and to the rear of proximate electrode 11 and away from the arc, is maintained at a considerably lower temperature than the top of pedestal 7 and the sealing frit thereon. As a result, excess amalgam condenses and collects in the bottom of the groove and not on or about the frit at 18 on the pedestal.

Figure 1:
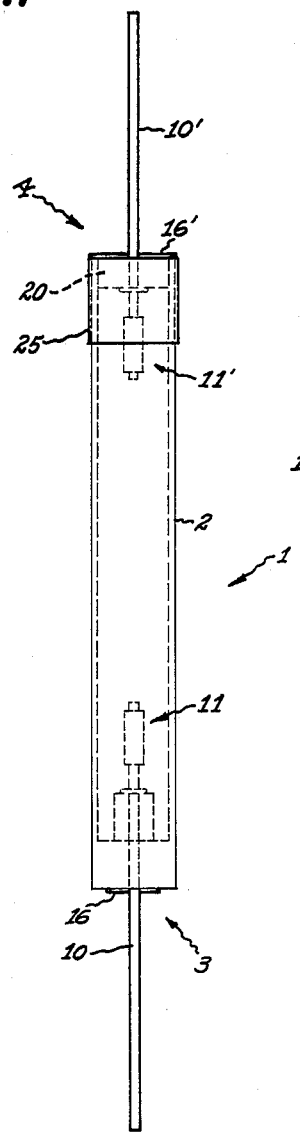
FIG. 1 is a side elevation view of a high pressure sodium vapor arc tube or discharge envelope embodying the invention in preferred form.

Amalgam is prevented from condensing on the sealing frit corner fillet 22 at the cemented end of the arc tube by maintaining that end at a higher temperature. This is readily achieved by locating a radiation shield at that end, as by wrapping a ring 25 of reflective metal such as niobium or tantalum about the end as shown in FIG. 1. Alternatively, the end temperature may be raised by shortening the shank 13' or by making the weld knot 12' closer to the upset 15' in order to reduce the spacing between electrode 11' and alumina disc 20. Of course both a radiation shield and reduction of the distance from electrode to disc may also be used simultaneously.

The heat balance in the lamp makes ring chamber 8 the coolest place in the arc tube and excess amalgam will always collect in it irrespective of the orientation or attitude in which the lamp is operated. However if the lamp is operated with the ring chamber up, mechanical shock or vibration may dislodge a droplet of amalgam from the chamber. Sudden vaporization of the droplet may then cause annoying brightening and flickering and the rise in vapor pressure may even extinguish the lamp. The thermal shock of a droplet striking the wall forward of the electrode occasionally cracks the ceramic arc tube.

In preferred form, my invention prevents the foregoing and provides a truly universal burning lamp resistant to shock and vibration. The degree of vibration resistance depends on the capillary force exerted in the ring chamber. Dimension A, the chamber width which is the gap between tube wall and pedestal wall, determines capillarity, the smaller the gap, the greater the capillary attraction or force. The practical range is from 0.2 to 2.5 millimeters. For a capillary retention force of 4G, that is 4 times the force of gravity, dimension A should be about 1 mm. For heavy duty lamps intended for applications subject to excessive vibration as in construction equipment, dimension A should be chosen smaller. Dimension B, the chamber depth, together with dimension A determines the volume of the chamber. Its preferred value is determined by constraining the dose to fill the chamber to not in excess of about 80% of its volume. Dimension B is in the range of about 10% to 100% of the internal diameter of the tube. For the illustrated arc tube having an internal diameter of 4 mm and intended for a 50 watt lamp, dimension B is 1.5 mm. An advantage of a deeper and larger chamber is the capability of dosing the lamp with more amalgam for a longer lamp life without suffering dislocation in typical applications subject to vibration.

The particular arc tube by reference to which the invention has been described in detail is intended as an illustrative example only. It is therefore desired that the invention be limited only by the appended claims which are intended to cover all modifications falling within its spirit and scope.

What I claim as new and desire to secure by Letters Patent of the United States is:

1. A high pressure metal vapor lamp comprising:

a tubular envelope of light-transmitting material resistant to the attack of alkali metal vapor at high temperatures, said envelope being a ceramic tube having at one end a plug portion forming an integral part of the tube, said plug portion having an aperture therethrough and including a pedestal portion extending inwardly from an outer region joined to the tube, and a wire inlead extending through the aperture and sealed therein by sealing frit, an apertured ceramic plug cemented by sealing frit to the other end of said tube and having a wire inlead extending through and sealed in the aperture therein, a pair of electrodes within said envelope supported on the inner ends of said inlead wires, an ionizable medium including mercury-alkali metal amalgam sealed within said envelope in a quantity exceeding that vaporized during lamp operation whereby an unvaporized excess remains in liquid state, said pedestal portion together with the tube wall defining a ring chamber located next to the tube wall and to the rear of the proximate electrode in which unvaporized amalgam can collect, and wherein the ring chamber is dimensioned to hold the entire charge of amalgam by capillary attraction irrespective of lamp orientation or attitude.

2. A lamp as in claim 1 wherein the ceramic is polycrystalline alumina.

3. A lamp as in claim 2 wherein the alkali metal is sodium.

4. A lamp as in claim 3 wherein the sealing frit comprises primarily aluminum oxide and calcium oxide.

5. A lamp as in claim 4 including means raising the temperature of the cemented end of the alumina tube above that of the integrally plugged end during operation.

6. A lamp as in claim 5 wherein said raising means includes at least one of a radiation shield about the cemented end of the alumina tube and a shorter distance from electrode to plug at the cemented end.

7. A lamp as in claim 6 wherein the ring chamber width (dimension A) is in the range of 0.2 to 2.5 millimeters and the ring chamber depth (dimension B) is in the range of 10% to 100% of the internal diameter of the tube.

8. A lamp as in claim 7 wherein dimension A is about 1 mm, dimension B is about 1.5 mm and the internal diameter of the tube is about 4 millimeters.

9. A lamp as in claim 7 wherein the ring chamber dimensions are selected to constrain the dose of mercury-sodium amalgam to fill the chamber to not in excess of 80% of its volume.

* * * * *